US005733647A

United States Patent [19]

Moore, III et al.

[11] Patent Number: 5,733,647

[45] Date of Patent: Mar. 31, 1998

[54] INSOLE

[75] Inventors: Dan T. Moore, III, Cleveland Heights; Maurice E. Wheeler, Ashtabula; James W. Hoover, Akron; William H. Weber, Novelty, all of Ohio

[73] Assignee: Polymer Innovations, Inc., Cleveland, Ohio

[21] Appl. No.: 851,807

[22] Filed: May 6, 1997

Related U.S. Application Data

[63] Continuation of Ser. No. 308,091, Sep. 16, 1994, abandoned, which is a continuation-in-part of Ser. No. 93,282, Jul. 16, 1993, Pat. No. 5,555,584, which is a continuation-in-part of Ser. No. 2,281, Jan. 8, 1993, abandoned, which is a continuation-in-part of Ser. No. 972,237, Nov. 5, 1992, abandoned.

[51] Int. Cl.[6] ..... B32B 27/00; A43B 13/38

[52] U.S. Cl. ..... 428/304.4; 428/423.1; 428/424.2; 428/500; 428/501; 428/515; 428/522; 36/43; 36/44; 36/71; 36/93

[58] Field of Search ..... 428/500, 501, 428/515, 522, 423.1, 424.2, 304.4; 36/43, 44, 71, 93

[56] References Cited

U.S. PATENT DOCUMENTS

| | | | |
|---|---|---|---|
| 1,093,608 | 4/1914 | Delaney | 36/43 X |
| 2,838,776 | 12/1958 | Tax . | |
| 3,257,742 | 6/1966 | Feinberg . | |
| 3,575,780 | 4/1971 | Trieschmann et al. | 273/DIG. 4 |
| 3,641,688 | 2/1972 | von den Benken | 36/43 |
| 3,692,023 | 9/1972 | Phillips et al. | 128/90 |
| 3,730,169 | 5/1973 | Fiber | 36/44 X |
| 3,780,140 | 12/1973 | Hammer . | |
| 3,782,390 | 1/1974 | Johnson | 128/90 X |
| 3,791,050 | 2/1974 | Egtvedt | 36/28 |
| 3,895,405 | 7/1975 | Edwards | 12/146 M |
| 3,905,376 | 9/1975 | Johnson et al. | 128/90 X |
| 3,968,577 | 7/1976 | Jackson | 36/43 |
| 3,977,033 | 8/1976 | Tabroff | 12/54.3 |
| 3,981,037 | 9/1976 | McCroskey, Sr. | 36/44 X |
| 4,006,542 | 2/1977 | Larson | 36/43 |
| 4,105,025 | 8/1978 | Wang et al. | 128/90 |
| 4,108,928 | 8/1978 | Swan, Jr. | 264/26 |
| 4,120,064 | 10/1978 | Salomon | 12/142 R |

(List continued on next page.)

FOREIGN PATENT DOCUMENTS

| | | | |
|---|---|---|---|
| 2052020 | 1/1993 | Canada | 36/41 |
| 3437786 | 4/1986 | Germany | 36/44 |
| 2233103 | 10/1987 | Japan | 36/43 |
| WO85/03624 | 8/1985 | WIPO | 36/93 |

OTHER PUBLICATIONS

"Poly(VINYL CHLORIDE)", *Kirk–Othmer Concise Encyclopedia of Chemical Technology*, (John Wiley & Sons, Inc., 1985), pp. 1230–3, particularly Table 1.

*Dupont Elavloy 741 742*, technical data brochure, 7 pages (The Dupont Company, approx. 1983).

*Dupont Elvaloy 741 & 742 for PVC Compounds with Improved Quality, Extended Life*, technical data brochure, 3 pages (The Dupont Company, believed to be prior to 1990).

*Dow Corning STI Technical Information, Silastic Q4–4758 & Q4–4768 Silicone Rubber*, 4 pages (Dow Corning STI, 1991).

*Dow Corning STI Technical Information, STI (Type) T Catalyst*, 4 pages (Dow Corning STI, 1991).

*Primary Examiner*—Terrel Morris

*Attorney, Agent, or Firm*—Pearne, Gordon, McCoy & Granger LLP

[57] ABSTRACT

A removable insole is provided which includes a layer of thermoplastic material, the thermoplastic material preferably including ethylene vinyl acetate and ethylene vinyl acetate modified by the addition of carbonyl groups. A custom-fitting insole is preferably produced by heating a substantially flat insole in a microwave oven until the thermoplastic material softens, placing the heated insole in a shoe, and having a person insert their foot into the shoe and walk around to form an impression.

16 Claims, 2 Drawing Sheets

U.S. PATENT DOCUMENTS

| | | | |
|---|---|---|---|
| 4,128,951 | 12/1978 | Tansill | 36/44 |
| 4,229,546 | 10/1980 | Swan, Jr. | 521/55 |
| 4,272,898 | 6/1981 | Tansill | 36/44 |
| 4,309,585 | 1/1982 | Doi et al. | 99/342 X |
| 4,366,630 | 1/1983 | Bloom | 36/30 R |
| 4,403,007 | 9/1983 | Coughlin | 428/95 |
| 4,405,730 | 9/1983 | Cohen | 524/35 |
| 4,413,429 | 11/1983 | Power | 36/44 |
| 4,433,494 | 2/1984 | Courvoisier et al. | 36/93 X |
| 4,483,333 | 11/1984 | Wartman | 128/90 |
| 4,503,576 | 3/1985 | Brown | 12/146 M |
| 4,520,581 | 6/1985 | Irwin et al. | 36/88 |
| 4,534,121 | 8/1985 | Autry | 36/35 R |
| 4,603,493 | 8/1986 | Eston | 36/44 X |
| 4,614,680 | 9/1986 | Fry et al. | 428/158 |
| 4,617,921 | 10/1986 | Seeler | 128/89 R |
| 4,671,267 | 6/1987 | Stout | 128/156 |
| 4,700,403 | 10/1987 | Vacanti | 36/71 X |
| 4,770,648 | 9/1988 | Gillis | 441/70 |
| 4,783,910 | 11/1988 | Boys, II, et al. | 36/107 |
| 4,821,708 | 4/1989 | Guignard et al. | 128/82.1 |
| 4,888,225 | 12/1989 | Sandvig et al. | 428/71 |
| 4,901,390 | 2/1990 | Daley | 12/142 N |
| 4,933,525 | 6/1990 | St. Phillips | 219/10.55 E |
| 5,003,708 | 4/1991 | Daley | 36/44 |
| 5,027,801 | 7/1991 | Grim | 128/80 M |
| 5,051,463 | 9/1991 | Yukimoto et al. | 524/306 |
| 5,067,255 | 11/1991 | Hutcheson | 36/43 |
| 5,067,257 | 11/1991 | Coomer | 36/93 |
| 5,101,580 | 4/1992 | Lyden | 36/93 |
| 5,123,180 | 6/1992 | Nanning | 36/93 X |
| 5,138,774 | 8/1992 | Sarkozi | 36/164 |
| 5,149,588 | 9/1992 | Fukushima et al. | 36/93 X |
| 5,150,490 | 9/1992 | Busch et al. | 12/146 M |
| 5,258,212 | 11/1993 | Tomaru et al | 428/36.8 |
| 5,343,638 | 9/1994 | Legassie et al. | 36/28 X |
| 5,555,584 | 9/1996 | Moore, III et al, | 36/43 X |

INSOLE

This application is a continuation of application Ser. No. 08/308,091, filed Sep.16, 1994, now abandoned, which is a continuation-in-part of application Ser. No. 08/093,282 filed Jul. 16, 1993,now U.S. Pat. No. 5,555,584, which continuation-in-part of application Ser. No. 08/002,281 filed Jan. 8, 1993, now abandoned, which is a continuation-in-part of application Ser. No. 07/972,237 filed Nov. 5, 1992, now abandoned. The entire contents of these applications are incorporated herein by reference.

BACKGROUND OF THE INVENTION

This invention relates generally to custom-fitting articles and compositions useful in making same and in particular to custom-fitting insoles.

DESCRIPTION OF RELATED ART

There have been a number of approaches to providing custom-fitting insoles for footwear. In one approach, different chemicals are mixed and a chemical reaction is initiated in a footbed, the person then steps into the footwear or shoe and forms an impression and the material is allowed to cure before the footbed is used. See U.S. Pat. Nos. 4,520,581; 4,128,951; 2,838,776; and 4,888,225. U.S. Pat. No. 3,968,577 discloses a similar system where the curing may also be via heating. However, in these processes if the fit is not right the first time the footbed cannot be remolded and must be discarded.

Other patents disclose a shoe, sandal, or insole having a layer of a thermoplastic material. The thermoplastic material is heated, thus softening it. The person steps into the shoe and makes an impression. The material then cools, retaining the impression of the foot. See U.S. Pat. Nos. 3,641,688; 4,413,429; 4,433,494; 4,503,576; 3,895,405; and 4,901,390. The content of all the foregoing patents is incorporated herein by reference. However, most of the foregoing thermoplastic materials are foams which have poor compression set properties and break down and compress over time, others are nonfoams which are unduly hard, have unduly high specific gravity, and have insufficient elasticity and resilience, and the unformed insoles are not maintained at a heated, ready-to-try-on, temperature.

It is an object of this invention to provide a custom-fitting insole which has low raw material costs, is a lightweight, low-density non-foam thermoplastic which can be molded at less than 200°F. and can be remolded, can withstand long periods at elevated temperatures, provides a well-defined impression, is durable, flexible, resilient, and long-lasting, and can be quickly molded and provided to a customer.

SUMMARY OF THE INVENTION

A removable insole is provided comprising a layer of thermoplastic material shaped to fit as an insole in a shoe and capable of being heat-softened and conformed to the underside of at least a portion of a person's foot. The thermoplastic material comprises a first component and a second component, the first component being selected from the group consisting of ethylene copolymers, ethylene terpolymers, and mixtures thereof, the second component being selected from the group consisting of ethylene terpolymers which are ethylene vinyl acetate modified by the addition of carbonyl groups. Methods of producing a custom-fitting insole are also provided.

DETAILED DESCRIPTION OF THE PREFERRED EMBODIMENTS

Figure 1:
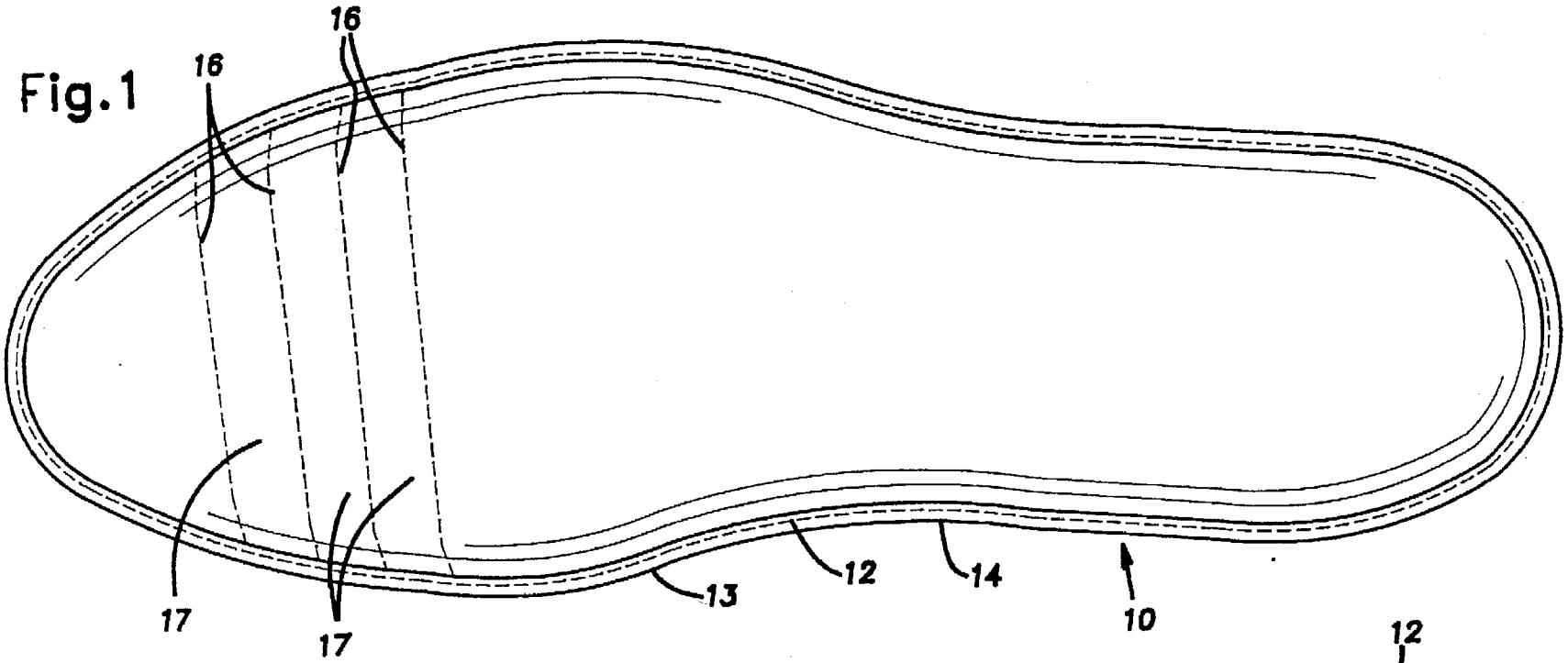
FIG. 1 is a top view of a removable insole in accordance with the present invention.
Figure 3:
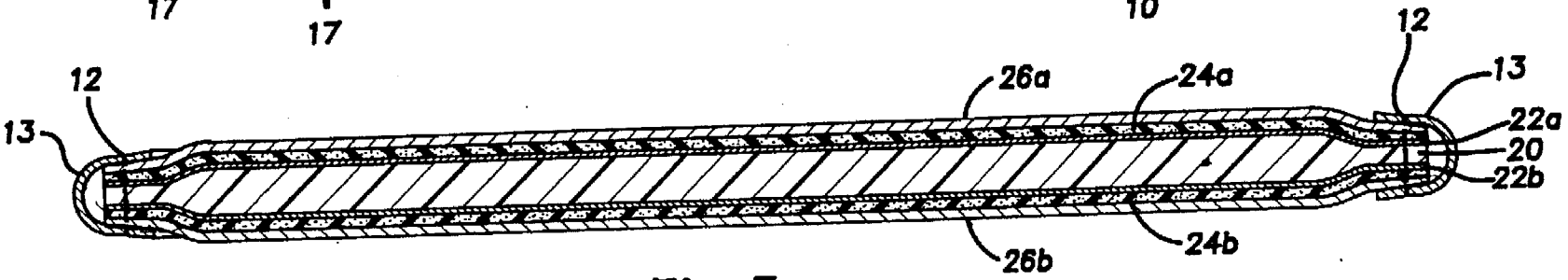
FIG. 3 is a sectional view taken along line 3—3 of the removable insole shown in FIG. 2.

With reference to FIGS. 1 and 3, there is shown a removable insole 10 which has the general shape of the underside or bottom of a person's foot or of the interior bottom of a shoe or boot. Stitching 12 about ⅛ inch in from the perimeter 14 of the insole secures binding 13 and helps to hold the layers of the insole together. Binding 13 is preferably coated nylon or tightly-woven cotton. Binding 13 contains any excess or residual thermoplastic material near the edge of the insole and gives a finished appearance. FIG. 3 shows the layers of the insole 10. Thermoplastic material layer 20, preferably and generally about 1/14–¾, more preferably about 1/12 –1/4, more preferably about 1/10, inches thick (the edge portions being thinner as shown or preferably so thin as to be hardly noticeable), is provided as the center layer of the insole. Barrier film layers **22*a* and 22*b* are provided above and below the thermoplastic material layer 20. Cushioning foam or flexible foam layer 24*a* is provided above barrier film layer 22*a*, and cushioning foam or flexible foam layer 24*b* is provided below barrier film layer 22*b*, both foam layers being adjacent thermoplastic material layer 20. Fabric layers 26*a* and 26*b* are provided on the top and bottom, respectively, of the insole 10**.

Figure 2:
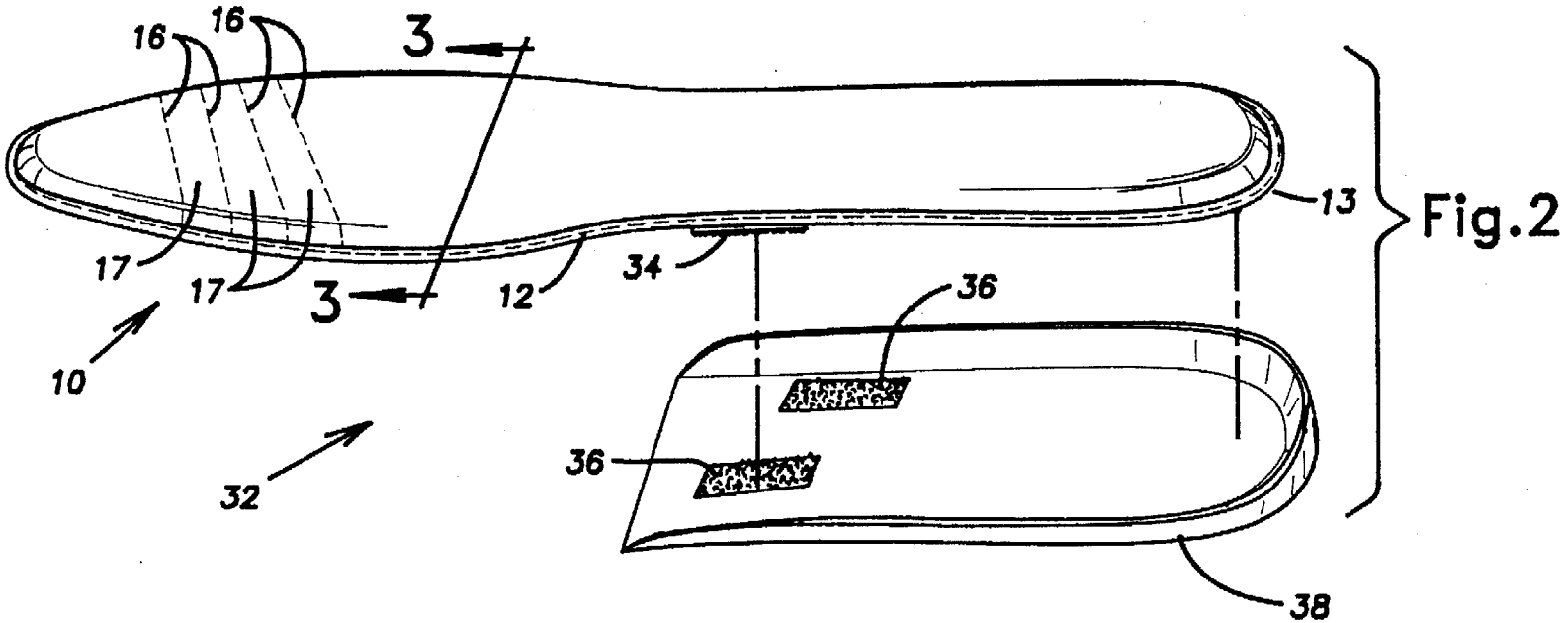
FIG. 2 is an exploded view of the removable insole of FIG. 1 in conjunction with an optional heel cup.
Figure 4:
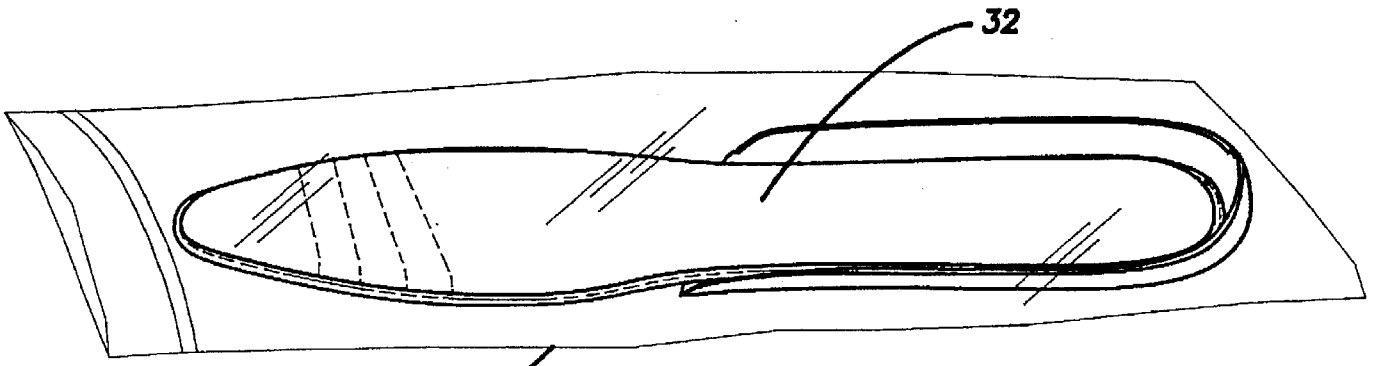
FIG. 4 is a perspective view of a removable insole with optional heel cup attached inside a water-tight reclosable bag.

Optionally, as shown in FIGS. 2 and 4, a flexible foam or plastic foam or foam rubber heel cup 38 may be attached to the bottom of the insole 10 preferably by hook and loop fasteners 36 and 34 (such as Velcro brand hook and loop fasteners), although other attachment means such as adhesive may be used. Hook and loop fasteners 36 are glued or otherwise attached to the top of heel cup 38 and engage complimentary fasteners 34 glued or otherwise attached to the bottom of the insole 10. The heel cup is preferably ethylene vinyl acetate (EVA) foam, which is less costly. Alternatively, stitching may be used around the heel area of the insole 10 to form a heel cup, and an arch support, as known in the art, may be added. Optionally, the insole may be for part of the foot, such as the back portion or the front portion or the back three quarters, rather than the whole foot.

One common problem in custom-fitting insoles is that as the insole is formed and worn, the thermoplastic material tends to flow or migrate towards and "bunch up" or mound in the toe area. As shown in FIG. 1, restriction means or multiple rows of stitching 16 (preferably through the entire thickness of the insole, including the two fabric layers) transverse to the longitudinal axis of the insole form baffle areas 17, which interrupt this migration and minimize "bunching up" in the toe area, particularly between the toes and the ball of the foot.

The barrier film layers **22*a* and 22*b*** are preferably a layer of flexible film such as polyurethane or polypropylene (thin), preferably 1 mil or less thick. The barrier film layer restricts flow of thermoplastic material into the foam layer and provides good adhesion to the thermoplastic material, adds tensile strength to the insole, is thin enough to allow a distinct impression to be made in the insole, and can withstand heating or microwave energy without degrading or melting. Less preferably, in place of the barrier film layers can be substituted Tricot fabric weave mesh from Faytex Corp., Weymouth, Mass.

The cushioning foam layers 24a and 24b are preferably 0.125 inches thick, open cell, compressible low density polyethylene foam available from Faytex Corp. This is flexible foam. These layers provide additional cushioning and provide insulation between the foot of the person and the hot, softened thermoplastic material which allows the person to put the heated insole in their shoe, step into it to form the impression, and continue to wear the insole thereafter while it cools without having to remove it due to discomfort to allow it to cool. The person can "walk away" after putting the heat softened "to be formed" insole in their shoe. The fabric layers 26a and 26b are preferably a moisture-wicking fabric available as Dri-lex from Faytex Corp. These layers help keep the feet dry.

The binding 13, the thread used for stitching 12 and 16, the Velcro patches 34 and 36, and fabric layers 26a and 26b (particularly the exterior surfaces of these items) are preferably light colored (such as light tan, light grey, light blue, light green, etc.) rather than dark colored (such as dark brown, black, dark blue, dark green, etc.), since it has been found that the thermoplastic material heats up faster and thus softens more quickly in the microwave oven when the above-identified materials are light colored rather than dark colored. It is believed that when these materials are darker colored they absorb more microwave energy, thus preventing such energy from getting to the thermoplastic material. Faster heating of the thermoplastic material means faster service to the customer or consumer and is thus desirable. Also, the coloration should be uniform throughout for even heating.

The thermoplastic material, which is solid at 80° F., is preferably the following formulation:

1. 45–95, more preferably 50–90, more preferably about 75–85, weight percent ethylene vinyl acetate (EVA)
2. 10–40, more preferably 15–25, more preferably about 18, weight percent modified EVA
3. 0.5–15, more preferably 1–5, more preferably about 2, weight percent polyoctenamer rubber.

Less preferably the formulation is:

1. 45–95, more preferably 50–90, more preferably about 75–85, weight percent EVA
2. 10–40, more preferably 15–25, more preferably about 18, weight percent modified EVA.

Component No. 1 above (EVA) is preferably Product AT 2850M from AT Plastics Inc., Brampton, Ontario, Canada, is preferably 28% vinyl acetate, less preferably 24 to 33% vinyl acetate, preferably has a relatively low molecular weight (approximately 14,000 to 26,000 weight average), preferably has a relatively high melt index (preferably 850, less preferably 400 to 1000, dg/min.), preferably has a ring and ball softening point of about 150°–170° F., more preferably 160° F., and preferably has a specific gravity of 0.96 or less. It can be in pellet or powder form. Product AT 2850M has a tensile strength of 200 psi, 190% elongation at break, a flexural modulus 1% secant of 1060 psi, a Shore A hardness of 67, a ring and ball softening point of 169° F., a melt temperature of 149° F., and a specific gravity of 0.944. One advantage of EVA is its low cost.

The modified EVA is preferably Elvaloy 741, less preferably Elvaloy 742. Both are an ethylene terpolymer and both are ethylene vinyl acetate modified by the addition of carbonyl groups, said carbonyl groups being incorporated as part of the main chain. The phrase ethylene terpolymers which are ethylene vinyl acetate modified by the addition of carbonyl groups as used herein includes Elvaloy 741 and 742. Elvaloy 741 is compatible with EVA, lowers the softening point of the EVA, increases and controls viscosity, increases flexibility, and enhances resistance to perspiration, body oils, and microbial growth. It is available from DuPont and has a molecular weight of greater than 250,000, a specific gravity of 1, tensile strength of 860 psi, 950% elongation at break, an elastic modulus of 1150 psi, a melt index of 35–40, a ring and ball softening point of 106° C., a crystalline melting temperature of 151° F., and a Shore A durometer hardness of 70. It can be used in pellet or powder form. Sufficient modified EVA is added to lower the softening point to the desired range but also to provide a thermoplastic material in which an effective impression can be made while not detrimentally affecting the other desired performance characteristics. Ethylene vinyl acetate modified by the addition of carbonyl groups is believed to have unique properties as described above which make it particularly useful in the present invention.

The polyoctenamer rubber is preferably trans-polyoctenamer rubber, available as Vestenamer 6213 from Huls America Inc., Piscataway, N.J.. It has a whole polymercyclic structure. It has a melting point of approx. 86° F., specific gravity of 0.89, an average molecular weight of 120,000 with a very broad molecular weight distribution, a viscosity at 23° C. of 120–140 ml/g, a Mooney viscosity ML (1+4) 100° C. of less than 10, and a melt index MFI 190° C./2.16 kg of 3.5. It enhances the heat stability of the thermoplastic material and also enhances extrusion of the product.

So long as a sufficiently low softening point for the overall thermoplastic material is achieved, other ethylene copolymers and/or terpolymers or mixtures thereof can be substituted, in whole or in part, for the ethylene vinyl acetate, including ethylene methyl acrylate, ethylene ethyl acrylate, ethylene butyl acrylate, and ethylene vinyl acetate acid terpolymer such as ELVAX 4310 from DuPont.

Preferably, the thermoplastic material has a ring and ball softening point of 140°–200° F., more preferably 150°–170° F., more preferably about 160° F., has a melting point of 145° to 155°F., has a melt index of 200 to 500 dg/min., has a consistency at 160° F. approximately like masticated chewing gum so that an effective impression of the foot can be made, has a Mooney viscosity ML (1+4) at 160° F. of less than 10, and has the following physical characteristics at 72° F. or other standard conditions: Shore A hardness of 50–90, preferably 60–80, more preferably 65–70, tensile strength of 200–700 psi, more preferably 300–500 psi, compression set at 24 hrs. at room temperature of 15–30, preferably 20–25, more preferably 20, percent, flexibility of 3–7, more preferably 4–6, more preferably about 5 (measured at room temperature on a flexometer having a scale of 0 to 10 and operating at 300 cycles per minute), elongation at break of 200–1000 percent, more preferably 400 to 600 percent, and specific gravity of less than 1.2, more preferably less than 1.1, more preferably less than 1, more typically about 0.96. It is nonfoam and can be softened and remolded multiple times and preferably can be conformed to the underside of a person's foot while at 140°–200° F., more preferably 150°–170° F., more preferably about 160° F. Low density and light weight are desirable characteristics for insoles and footwear. The insole of the present invention is heat stable so that it can be maintained at 160° F. for 6 months or longer without degradation or significant deterioration or loss of physical properties.

It is desirable to minimize the mass of the non-thermoplastic material in the insole so that the thermoplastic material may be heated up (particularly in a microwave oven) faster. As the mass of the binding, fabric layers, foam layers, and barrier film layers increases, the time to heat the thermoplastic material 20 increases, which is undesirable. The materials other than the thermoplastic material are preferably transparent to microwave energy.

The insole 10 is preferably made as follows. The plastic materials are blended, melted, and fed into an extruder and extruded in a layer or sheet of the appropriate thickness, such as 1/10 inch, onto one of the barrier film layers 22*a*, 22*b*. The thermoplastic material layer 20, barrier film layers 22*a* and 22*b*, foam layers 24*a* and 24*b*, and fabric layers 26*a* and 26*b* are fed through a calender and pressed together and smoothed, creating an insole blank layer preferably about 1/4 inch thick. Each fabric layer is preferably adhesively attached to its corresponding foam layer before the calendering operation and the foam layers may optionally be adhesively attached to the barrier film layers before the calendering operation.

Preferably the calendered multi-laminate is kept warm, typically 150°–160° F., to keep the thermoplastic material semi-fluid. The insoles are then die-cut. The die is preferably modified by attaching a piece of dense foam rubber about 1/4 inch wide along the perimeter of the die along the side of the cutting rule or the inside edge of the die. As the cutting rule cuts the insole, the dense foam rubber engages the outermost 1/4 inch of the insole and displaces or squeezes out the semi-fluid thermoplastic material, forming a sewing lip. Multiple rows of stitching 16 are stitched in while the insole is cold; thus the thermoplastic material layer 20 is not compressed. Binding 13 is provided and the sewing lip is stitched; alternatively the sewing lip may be sealed with a bead of hot melt adhesive or other sealing means.

The insole may be custom-fitted to the foot of a person by heating it to a preselected softening point such as 150°–170° F. to soften the thermoplastic material, placing the insole (preferably with optional heel cup 38 attached) inside the shoe or other footwear in which it will ultimately be worn, and having the person insert their foot, walk around to conform the insole to the underside of the person's foot, and continue to walk around while the insole cools (typically about 5 minutes). The foam layer 24*a* insulates the foot from the heat. Preferably the insole need not be removed from the shoe to cool and the foot need not be removed from the shoe during this period. The finished insole is elastic and resilient. If the fit is not right, the insole can be reheated, resoftened, flattened, reheated, and a new impression made.

The insole is heated preferably in a microwave oven, such as by placing it in a conventional 700 or 900 watt microwave oven and heating (via microwave energy) at full power for preferably less than 120, more preferably less than 60, more preferably about 40–45, seconds. It is known that there are variations in the heating abilities of microwave ovens, including microwave ovens of the same model number. Preferably both insoles of a pair are heated together. Preferably both insoles are rotated on a non-energy-absorbing rotating tray inside the microwave oven. Not rotating an insole on a rotating tray may lead to uneven heating of the insole. A preferable rotating tray which absorbs less energy is made of polypropylene, preferably 1/4 to 1/2 inch thick. The less energy it absorbs, the more is available to heat the thermoplastic material layer 20. Optionally, an outline of one or two insoles may be provided (such as by painting or embossing) on the rotating tray to aid in placement of the insoles to be microwaved. Consistent placement in the same location is important for consistent, predictable and even heating. Optionally the insole can be turned over or inverted during the heating cycle, although preferably the insole is thin enough that it doesn't have to be turned over. Preferably the insole is microwaved upside down without being turned over, since this heats and softens the top portion of the insole more than the bottom portion of the insole so that the bottom of the insole is stiffer and can go into the shoe with less chance of folding or buckling while the top portion is softer and soft enough to be effectively molded and impressed with the foot, although the bottom is still soft enough to conform to the inside of the shoe. Alternatively, to achieve the same result, the thermoplastic material layer 20 can be a co-extrusion of two layers with the bottom layer being of a material which softens a little bit less than the top layer. Other size microwave ovens can be used and for different heating periods, so long as the thermoplastic material is heated to the preselected softening point. Preferably, the type of microwave oven is preselected and the constituents of the thermoplastic material are preselected so that there is a match which permits the thermoplastic material in the insole to be heated to the softening point in about 1 minute or less. The materials of the insole are selected so that they can withstand the microwaving process. A heel cup made of EVA foam does not tolerate microwaving well, absorbs energy intended for the thermoplastic material, causes uneven heating of the thermoplastic material, and is preferably removed during the microwaving process. It may subsequently be reattached via the Velcro hook and loop fasteners 34 and 36. The insole 10 is preferably oriented flat on the rotating tray, not raised or tilted, to enhance even heating. Preferably the insoles are without other attachments or ornamentation when microwaved, to promote fast heating. Preferably the insole, particularly the thermoplastic material layer 20, is substantially flat and very flat to allow predictable, even microwave heating. Except for the edge portion, the thermoplastic material layer 20 is preferably flat such that preferably there is not more than 300, more preferably 200, more preferably 100, more preferably 50, more preferably 25, more preferably 10, more preferably 5, percent difference between the thickness of the thickest and thinnest parts.

Less preferably the insole may be heated by placing it in a sealed water-tight envelope or plastic bag and placing it in boiling water for a suitable period of time such as 15 minutes (turning over half way through the period). This is illustrated in FIG. 4, showing, as indicated at numeral 32, a removable insole with attached optional heel cup inside a reclosable plastic bag 30. Alternatively the insole may be heated without the optional heel cup. A suitable bag is a four-mil thick reclosable polyethylene bag available from Lemac, Inc., Akron, Ohio. One advantage of this method is that water boils at a precise temperature (adjusted for elevation). Boiling in water can be used to heat the insole to a precise, preselected controlled temperature. The softening point of the thermoplastic material can be preselected to match the preselected boiling water temperature to give more precise, controlled heating. This is less possible with microwave and convection ovens, the temperatures of which cannot be controlled as precisely. Hot water (at or above the softening point temperature of the thermoplastic material) can also be used to heat the insole.

Alternatively a number of insoles (one of each size) may be maintained at their softening point in a heated oven located on the premises of a shoe store, athletic store, etc. When the customer comes in, the insole of the proper size is removed from the heated oven and put immediately into the shoe for the impression to be made. The insole does not have to be heated separately because it is maintained in the heated oven at its softening point and is always ready-to-try-on. This method is quicker and more convenient for the customer, since the customer does not have to wait for the insole to be softened via heating. If the customer does not like the fit, the insole is put back in the heated oven, preferably stacked flat in a tray.

One advantage of the present invention is that the softening point of the thermoplastic material is particularly low to minimize the risk that the customer will be burned, so long as appropriate precautions are taken.

EXAMPLE 1

A pair of mens size 10 insoles (the thermoplastic material layer 20 being about 1/10 inch thick) were prepared as shown in FIGS. 1 and 3 with the layers therein indicated. The thermoplastic material was 80 weight percent EVA (28% vinyl acetate) (being Product AT 2850M described above), 18 weight percent Elvaloy 741, and 2 weight percent Vestenamer 6213 polyoctenamer rubber, and had a softening point of about 153°–163° F. The insoles were heated together in a 900 watt microwave oven for about 45 seconds without being turned over (the polypropylene tray automatically rotated), which heated the thermoplastic material to its softening point. The insoles were then placed in a pair of shoes. A person weighing 185 lbs. then put the shoes on and walked on the insoles until they solidified, the person not experiencing substantial discomfort during said process. The insoles were inspected. They had a good, distinct impression, and were flexible and resilient. The insoles were then used by the person for about 30 days and did not deform or lose their compression set.

EXAMPLE 2

A pair of insoles similar to those of Example 1 were heat softened and conformed as in Example 1. After they had cooled and solidified, they were reheated in a microwave oven for about 1 minute, were flattened, cooled, reheated in a microwave oven for about 45 seconds, and conformed to the feet of a person as in Example 1. The insoles were subsequently inspected and found to be good, as in Example 1.

Although the preferred embodiments of this invention have been shown and described, it should be understood that various modifications and rearrangements of the parts may be resorted to without departing from the scope of the invention as disclosed and claimed herein.

What is claimed is:

1. A removable insole comprising a layer of thermoplastic material shaped to fit as an insole in a shoe and capable of being heat-softened and conformed to the underside of at least a portion of a person's foot, said thermoplastic material comprising a first component and a second component blended together, said first component being selected from the group consisting of ethylene copolymers, ethylene terpolymers, and mixtures thereof, said second component being selected from the group consisting of ethylene terpolymers which are ethylene vinyl acetate modified by the addition of carbonyl groups, said carbonyl groups being incorporated as part of the main chain, said thermoplastic material having a ring and ball softening point of not more than 200° F.

2. An insole according to claim 1, further comprising a first layer of flexible foam adjacent said thermoplastic material layer.

3. An insole according to claim 2, said thermoplastic material layer having a first side and a second side, said insole further comprising a first barrier film layer contacting said first side and a second barrier film layer contacting said second side, a barrier film layer being disposed between said thermoplastic material layer and said flexible foam layer.

4. An insole according to claim 1, said insole having an exterior top surface and an exterior bottom surface, said exterior surfaces being substantially light colored.

5. An insole according to claim 1, said thermoplastic material layer being substantially flat.

6. An insole according to claim 1, said insole having a forward portion and a rear portion, said insole having a toe area, said insole having restriction means which form at least one baffle area in said forward portion to interrupt flow of thermoplastic material toward the toe area.

7. An insole according to claim 1, said thermoplastic material having a ring and ball softening point between 140° and 200° F.

8. The insole of claim 1, further comprising a removably attached heel cup.

9. An insole according to claim 3, said insole having an exterior top surface defined by a first fabric layer and an exterior bottom surface defined by a second fabric layer, said thermoplastic material being nonfoam, said first component being ethylene vinyl acetate.

10. An insole according to claim 1, said insole being shaped to fit as an insole in a shoe.

11. An insole according to claim 1, said thermoplastic material having a ring and ball softening point 150–170°F.

12. An insole according to claim 1, said thermoplastic material having a ring and ball softening point of about 160° F.

13. An insole according to claim 1, said thermoplastic material being 45–95 weight percent ethylene vinyl acetate and 10–40 weight percent said ethylene vinyl acetate modified by the addition of carbonyl groups.

14. An insole according to claim 1, said thermoplastic material being 50–90 weight percent ethylene vinyl acetate and 15–25 weight percent said ethylene vinyl acetate modified by the addition of carbonyl groups.

15. An insole according to claim 1, said thermoplastic material being 75–85 weight percent ethylene vinyl acetate and about 18 weight percent said ethylene vinyl acetate modified by the addition of carbonyl groups.

16. A removable insole comprising a layer of thermoplastic material shaped to fit as an insole in a shoe and capable of being heat-softened and conformed to the underside of at least a portion of a person's foot, said thermoplastic material comprising a first component and a second component blended together, said first component being selected from the group consisting of ethylene copolymers, ethylene terpolymers, and mixtures thereof, said second component being selected from the group consisting of ethylene terpolymers which are ethylene vinyl acetate modified by the addition of carbonyl groups, said carbonyl groups being incorporated as part of the main chain, said thermoplastic material being 45–95 weight percent ethylene vinyl acetate copolymer.

* * * * *

UNITED STATES PATENT AND TRADEMARK OFFICE

CERTIFICATE OF CORRECTION

PATENT NO. : 5,733,647

DATED : March 31, 1998

INVENTOR(S) : Dan T. Morre, III, et al.

It is certified that error appears in the above-indentified patent and that said Letters Patent is hereby corrected as shown below:

Column 8, line 31, claim 11, line 2, after "point" insert --of--.

Signed and Sealed this

Fifteenth Day of September, 1998

*Attest:*

*Attesting Officer*

BRUCE LEHMAN

*Commissioner of Patents and Trademarks*